United States Patent [19]

Krüger

[11] 4,116,268

[45] Sep. 26, 1978

[54] WATER TANK FOR TRANSVERSE FLOW RADIATOR

[75] Inventor: Hermann Krüger, Wolfsburg, Germany

[73] Assignee: Volkswagenwerk Aktiengesellschaft, Wolfsburg, Germany

[21] Appl. No.: 728,877

[22] Filed: Oct. 1, 1976

[30] Foreign Application Priority Data

Oct. 10, 1975 [DE] Fed. Rep. of Germany ..... 2445458
Jun. 24, 1976 [DE] Fed. Rep. of Germany ..... 2628331

[51] Int. Cl.[2] ..... F28B 9/10; F28F 9/02

[52] U.S. Cl. ..... 165/111; 123/41.54; 165/107 D; 165/174

[58] Field of Search ..... 123/41.54; 165/107 D, 165/110, 174, 111

[56] References Cited

U.S. PATENT DOCUMENTS

| | | | |
|---|---|---|---|
| 1,677,981 | 7/1928 | Muir | 165/107 D |
| 2,263,074 | 11/1941 | Dunham et al. | 165/174 |
| 3,051,450 | 8/1962 | White et al. | 165/107 D |
| 3,077,927 | 2/1963 | White et al. | 123/41.54 |
| 3,254,707 | 6/1966 | Ferguson | 165/107 D |
| 3,455,377 | 7/1969 | Hayes | 165/107 D |
| 3,604,502 | 9/1971 | Morse et al. | 123/41.54 |
| 3,989,103 | 11/1976 | Cieszko et al. | 123/41.54 |
| 4,011,905 | 3/1977 | Millard | 123/41.54 |

FOREIGN PATENT DOCUMENTS

| | | | |
|---|---|---|---|
| 1,956,589 | 5/1971 | Fed. Rep. of Germany | 123/41.54 |
| 2,435,632 | 2/1975 | Fed. Rep. of Germany | 165/178 |
| 1,270,238 | 4/1972 | United Kingdom | 123/41.54 |

*Primary Examiner*—Charles J. Myhre
*Assistant Examiner*—Sheldon J. Richter
*Attorney, Agent, or Firm*—Spencer & Kaye

[57] ABSTRACT

A water tank for a transverse flow radiator which tank is of the type including an overflow chamber separated from a main coolant stream collecting chamber by means of a substantially vertical partition, openings for permitting a secondary stream of coolant to flow through the overflow chamber and a fill tube opening into the overflow chamber and adapted to be provided with a pressure relief valve. The water tank is made in one piece as a cast or die-cast member with an overflow chamber which is disposed coaxially below the fill tube and which has a cross-sectional area which is equal to or less than that of the fill tube.

12 Claims, 4 Drawing Figures

WATER TANK FOR TRANSVERSE FLOW RADIATOR

BACKGROUND OF THE INVENTION

The present invention relates to a water tank for a transverse flow radiator and which comprises an overflow chamber partitioned from a main coolant stream collection chamber by a substantially vertical partition, with a secondary coolant stream passing through this overflow chamber into which opens a fill tube which is normally provided with a pressure relief valve.

Since the coolant circulating in the cooling system of, for example, an internal-combustion engine expands due to the heat of operation, it is customary in such radiators to provide an overflow vessel in which a volume of air is provided as a buffer. Generally, the fill tube for adding or replenishing coolant is also disposed at the overflow vessel as is a pressure relief valve which opens when a maximum permissible pressure in the cooling system is exceeded and initially permits part of the volume of air to escape. Radiators are also known which do not have a separate overflow vessel but in which this overflow vessel is integrated into the water tank as a compensation chamber which is separated from the main stream collecting chamber by a partition. In this case, the partition separating the overflow from the main stream collecting chamber must be fastened by a fastening process, for example by welding or soldering in heavy metal radiators. The attachment of the partition thus requires additional installation work in the production of the water tank.

SUMMARY OF THE INVENTION

It is therefore the object of the present invention to provide a water tank of the above-mentioned type for a transverse flow radiator which tank is distinguished by simpler design and thus provides new ways for appropriate manufacture. Additionally, safer discharge of the air contained in the cooling system into the overflow chamber is to be realized and the arrangement is to be such that when there is an excess pressure in the cooling system, initially only air and not the liquid coolant are discharged through the pressure relief valve.

This is accomplished according to the present invention in that the water tank, which includes a main stream collecting chamber separated by a substantially vertical partition from an overflow chamber, is made of one piece of material as a cast or die cast member and has an overflow chamber which is disposed coaxially below the fill tube with a cross-sectional area equal to or less than that of the fill tube. Due to the fact that the overflow chamber is arranged to be coaxial with the fill tube and has a cross-sectional area which advisable is tapered toward the bottom and which at its uppermost point is, at most, of the same size as the cross section of the fill tube, there exists the possibility of manufacturing the water tank in one piece in a casting or die casting process, for example out of plastic or aluminum. The core used for forming the overflow chamber can then be removed through the fill tube while the core used for forming the main stream collecting chamber is removed toward the open frontal face of the water tank.

According to a further feature of the invention, the overflow chamber is connected in its upper region with the main stream collecting chamber via a known overflow choke disposed in the partition and in its lower region with at least one lower series of pipes leading to the outlet or suction end of the radiator via a substantially horizontal connecting channel. This connecting channel may here be separated from the main stream collecting chamber by means of a horizontal rib in the water tank. During operation of the radiator, this channel is then used to extract the coolant, which has entered the overflow chamber in the secondary stream through the overflow choke, toward the water tank at the suction side of the radiator so that a coolant level is set in the overflow chamber which can be determined by appropriate dimensioning of the cross sections of the overflow choke and the connection channel.

DETAILED DESCRIPTION OF THE PREFERRED EMBODIMENTS

Figure 1:
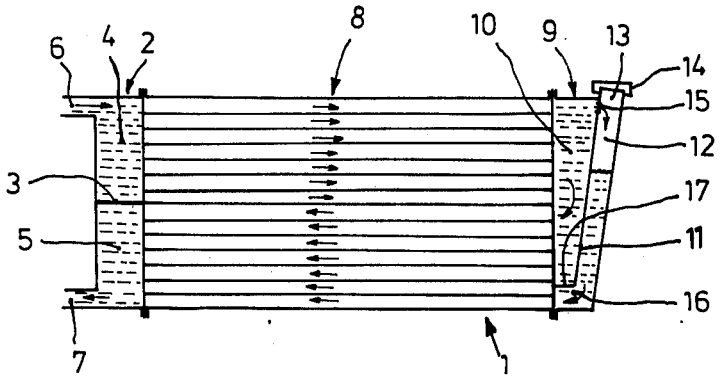
FIG. 1 is a schematic representation of a transverse flow radiator with U-shaped flow in which the water tank provided with the overflow chamber according to one embodiment of the invention is disposed on the side of the radiator opposite the connecting tubes.

Referring now to FIG. 1 of the drawings, there is shown a transverse flow radiator 1 with U-shaped coolant flow as it can be used, for example, in a cooling system of a water cooled internal-combustion engine, particularly of a motor vehicle engine. At its lefthand end, as seen in the drawing, the transverse flow radiator 1 is provided with a water tank 2 which is divided into two collecting chambers, i.e. an upper chamber 4 and a lower chamber 5, by means of a substantially horizontal partition 3. Collecting chamber 4 is provided with a coolant connection or tube 6 through which it receives the coolant which has been heated for example in the coolant jackets of an internal-combustion engine. In contradistinction thereto, a coolant connection or tube 7 provided at the bottom of collecting chamber 5 leads to a coolant pump (not shown in detail) which keeps the coolant circulating in the coolant system.

In a conventional manner, the core of the radiator 1 includes a bundle of horizontally arranged coolant pipes 8 through which the heat absorbed by the coolant in the internal-combustion engine is transferred to the ambient air, particularly to the high speed air stream created by movement of the vehicle. On the righthand side, as seen in the drawing, of the bundle of coolant pipes 8, a second water tank 9 is fastened. This water tank 9 includes a main coolant stream collecting chamber 10 which is separated from an overflow chamber 12 by means of a substantially vertical partition 11. The overflow chamber 12 is provided with a fill tube 13 which, as is conventional, can be locked by a lid or cap 14 which is provided with an integrated pressure relief valve. The overflow 12 is coaxial with and directly below the fill tube 13, and has a cross-sectional area which is largest at the upper end and at most is equal to that of the fill tube 13.

In order to permit a secondary stream of coolant to flow through the overflow chamber 12, an overflow choke 15 is provided in partition 11 at a point which is disposed as high as possible therein. Additionally, the lower end of the overflow chamber 12 is connected, via a connecting channel 16, with one or a plurality of the lowermost rows of the bundle of cooling pipes 8 which lead to the collecting chamber 5 of the lefthand water tank 2, i.e. the chamber which is provided with the suction or outlet tube 7. As shown, the connecting channel 16 is formed entirely within the tank 9 by providing the partition 11 with a transverse rib 17 which forms the lower end of the main stream collecting chamber 10. Depending on the cross-sectional conditions of the overflow choke 15 and connecting channel 16, which may possibly be provided with an opening toward the main stream collecting chamber 10, a coolant level is set in the overflow chamber 12 above which a column of air is disposed which acts as an elastic cushion to compensate for the heat expansion of the coolant as a result of increases in temperature.

Figure 2:
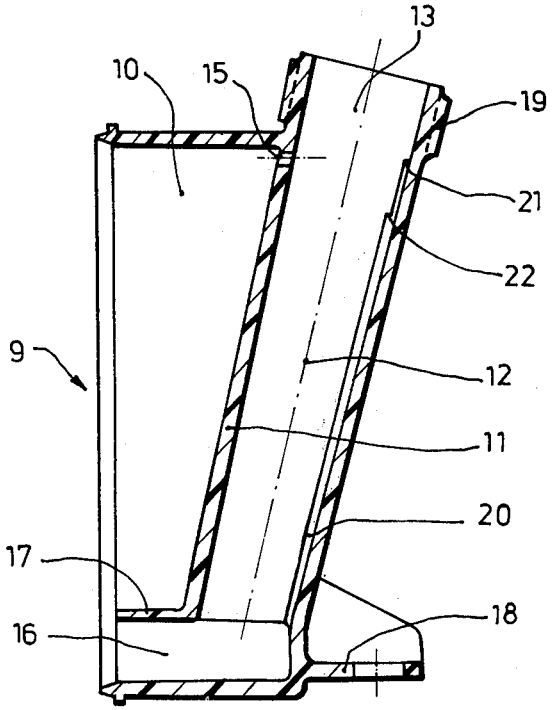
FIG. 2 is an enlarged longitudinal section through the embodiment of a water tank according to the invention as shown in FIG. 1.

FIG. 2 of the drawings shows a detailed sectional view of the tank 9 of FIG. 1. As shown, in addition to the features described above, the fill tube 13 is provided with an external thread 19 for the fastening of the lid 14 as well as with a mounting foot 18. Moreover, the inner contour of the overflow chamber 12, which, for example, may be cylindrical or, as indicated in the drawing, may taper downwardly, is provided with a rib 20 having fill markers 21 and 22 by means of which the coolant fill level may be monitored. Finally, as is clearly shown in this Figure, the tank 9 is a unitary structure and is completely open at its lefthand side as shown in FIG. 2.

During operation of the internal-combustion engine, coolant flows in the direction of the arrows shown in FIG. 1 driven by the coolant pump (not shown) provided in the external flow path connected between inlet tube 6 and outlet tube 7. The coolant flowing through the internal-combustion engine initially flows through coolant connection 6 into the pressure side collecting chamber 4 of water tank 2 from where it flows through the upper half of the bundle of pipes 8 toward the main stream collecting chamber 10 of the water tank 9. Here the flow of coolant is reversed and, via the lower half of the bundle of coolant pipes 8, flows into the collecting chamber 5 of the water tank 2 from which, via suction provided by the externally connected coolant pump, it exits through the coolant connection 7. Via the overflow choke 15, part of the coolant entering the main stream collecting chamber 10 enters the overflow chamber 12 and is brought from there through connecting channel 16 to the lowermost rows of pipes in the bundle of coolant pipes 8 which are also connected with collecting chamber 5 on the suction side of the radiator. The reason for this secondary stream of coolant passing through the overflow chamber 12 is that there the air contained in the coolant is separated and forms the buffer volume required to provide for expansion of the coolant. For this reason, by appropriate dimensioning of the overflow choke 15 and of connecting channel 16, respectively, a flow speed which is less in the overflow chamber 12 than in the main stream collecting chamber 10 is provided so that sufficient time is available for the complete and effective separation of the air.

After prolonged stoppage of the internal-combustion engine, the level of coolant will be uniform in the entire radiator 1, i.e. if the radiator is properly filled between markers 21 and 22, and the uppermost rows of the bundle of coolant pipes 8 will be the first in which there is no coolant. Once the internal-combustion engine is started, and thus the coolant pump begins operating, the coolant coming from the internal-combustion engine via inlet tube 6 initially presses the air present in the uppermost coolant pipes 8 into the main stream collecting chamber 10. Since all of the air cannot at once be pressed through overflow choke 15 into overflow chamber 12, a certain portion of the air will be carried along with the circulating coolant during the first cycles. After a period of time, however, all of the air present in the circulating coolant will have collected in the overflow chamber 12 and only a secondary quantity of coolant will pass through overflow choke 15 into overflow chamber 12 to charge the lowermost rows of the bundles of coolant pipes 8.

If, due to particularly intensive heating of the coolant and the resulting expansion of the coolant volume, an excess pressure develops in the circulating coolant, the air is discharged through the pressure relief valve integrated in the lid or cap 14 of fill tube 13. When cap 14 is opened while the internal-combustion engine is still hot from operation, the air will escape first and only thereafter the hot coolant.

The significant feature of the tank 9 according to the present invention is that the overflow chamber 12 is arranged coaxially with and directly below the fill tube 13 and has a cross-sectional area which is at most equal to that of the fill tube 13. Preferably, the overflow chamber 12 is tapered somewhat toward the bottom as shown. Thus, it becomes possible to manufacture the entire water tank 9, including main stream collecting chamber 10, connecting channel 16, overflow chamber 12 and fill tube 13, as one piece in a casting or die-casting process, since the casting core for forming the main stream collecting chamber 10 and the connecting channel 16 can be removed toward the left in the drawing and the cylindrical or conical casting core for forming the overflow chamber 12 and the fill tube 13 can be removed in an oblique, upward direction. The design according to the invention thus assures a compact configuration for the tank 9 which is simple and inexpensive to manufacture. Aluminum or plastic, for example a glass fiber reinforced polyamide, can now be used for the material of the tank 9.

Figure 3:
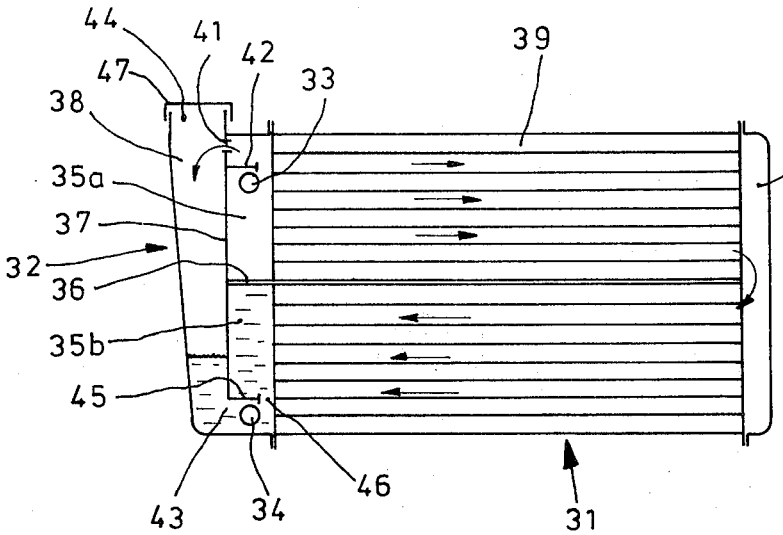
FIG. 3 is a schematic representation of a transverse flow radiator with U-shaped flow showing another embodiment of the invention in which the water tank provided with the overflow chamber is also provided with the connecting tubes for the coolant.

Turning now to FIG. 3, there is shown a transverse flow radiator 31 containing a further embodiment of a water tank 32 according to the invention. In this embodiment, the water tank 32 is provided with both a coolant entrance tube 33 and a coolant exit tube 34 which open into the tank 32 from the side of the radiator 31, i.e. perpendicularly to the plane of the figure. While the coolant entrance tube 33 opens into a first or upper partial collecting chamber **35*a*, the coolant exit tube 34 opens into a second or lower partial collecting chamber 35*b*, with the two chambers being separated from one another by a horizontal partition 36. Both collecting chambers 35*a* and 35*b*, through which the main stream of coolant flows, are separated from the overflow chamber 38, which is also provided in water tank 32, by a substantially vertical partition 37**.

Connected to and in communication with the tank 32 is a bundle of horizontally arranged coolant pipes 39 in which the coolant transfers the quantity of heat collected, for example, from a vehicle engine, to the ambient air, particularly to the fast flowing air stream created by movement of the vehicle. The other end of the bundle of coolant pipes 39 is fastened to a second water tank 40 in which the coolant flowing through the upper half of the bundle of coolant pipes 39 from partial collecting chamber 35*a* is deflected and returned to the second partial chamber 35*b* through the lower half of the bundle of coolant pipes 39.

As in the other radiator embodiments, the overflow chamber 38 of the water tank 32 receives a secondary stream of coolant for which purpose an overflow choke 41 is provided in partition 37 at a point as high as possible therein. In order to smooth the flow of incoming coolant to the overflow choke 41, a horizontal rib 42 is disposed in partial collecting chamber 35*a*, between the overflow choke 41 and the coolant entrance tube 33, with the rib 42 extending only partially across the chamber 35*a*. At its lower end, the overflow chamber 38 is connected, via a passage opening 43 in partition 37, with the lower partial collecting chamber 35*b* which is provided with the coolant exit or outlet tube 34. This lower partial collecting chamber 35*b* is also provided with a horizontally arranged rib 45 which is provided with an opening 46. The rib 45 and opening 46 reduce the flow for the coolant pipes 39 disposed above the rib 45 according to the cross section of opening 46.

As in the other embodiments, the tank 32 is likewise provided with a fill tube 44 which is disposed coaxially above the overflow chamber 38 and can be closed by means of a cap 47 provided with a pressure relief valve.

The flow speed in overflow chamber 38 is set by appropriate dimensioning of the overflow choke 41 or of passage opening 43, respectively, so that it will be less than the flow speed in the main stream collecting chambers 35*a* or 35*b*, respectively. Thus there is sufficient time available for the coolant to completely and effectively discharge the air.

Figure 4:
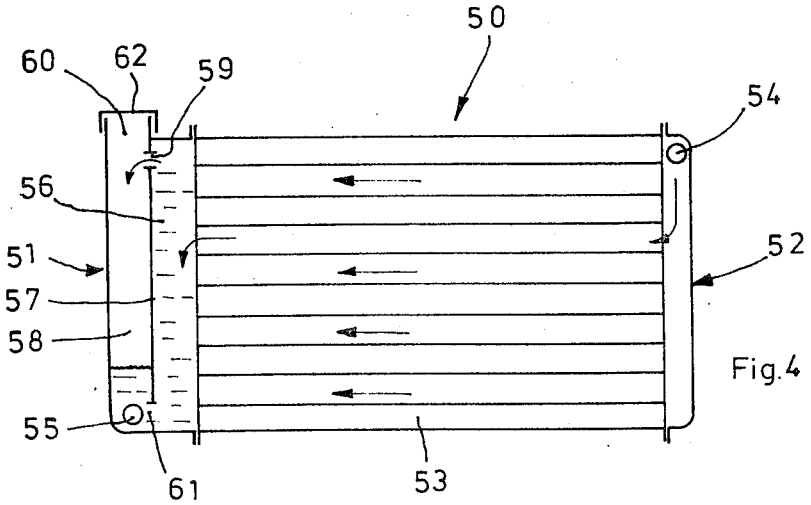
FIG. 4 is a schematic representation of a single stream transverse flow radiator showing still another embodiment of the invention in which the coolant outlet tube is arranged directly inside the overflow chamber of the water tank.

In the embodiment of FIG. 3, the left-hand water tank 32 includes the overflow chamber 38, the fill tube 44 for coolant replenishment, and the coolant intake and outlet tubes 33 and 34, while the second water tank 40 has a relatively simple design and serves only to deflect the main coolant stream. FIG. 4 shows a modified radiator embodiment wherein each water tank of the radiator is provided with a connecting tube.

In the embodiment of FIG. 4, there is shown a single flow transverse flow radiator 50, having a left-hand water tank 51, a right-hand water tank 52, and a bundle of coolant pipes 53 connected between the two water tanks 51 and 52. The coolant entrance tube 54 opens into the water tank 52 while the coolant outlet tube 55 opens into water tank 51. The water tank 51 is divided into a main stream collecting chamber 56 and an overflow chamber 58 by means of a substantially vertically arranged partition 57. The secondary coolant stream again flows through the overflow chamber 58, entering through an overflow choke 59 disposed in the upper region of partition 57. The lower region of partition 57 is provided with a passage opening 61 through which the coolant from main stream collecting chamber 56 can flow to the coolant outlet tube 55 which in this embodiment is disposed in overflow chamber 58. Finally, the tank 51 is provided with fill tube 60 which is covered by a cap 62 provided with a pressure relief valve, and which is arranged, as provided by the present invention, coaxially above the cylindrical or conically tapered overflow chamber 58. The cross section of the overflow choke 59 or of passage opening 61, respectively, is again selected so that the flow speed in overflow chamber 58 is relatively low compared to the flow speed in the main stream collecting chamber 56. The cross section of the overflow choke 59 in connection with that of passage opening 61, and analogously in the embodiment of FIG. 3 the cross section of the overflow choke 41 in connection with the cross section of opening 46 in rib 45 produce a pressure difference between overflow chamber 58 or 38, respectively, and collecting chamber 56 or 35*b*, respectively. This pressure difference is necessary in order to keep the coolant level in the overflow chamber 38 or 58, respectively, low enough so that sufficient space is available in the overflow chambers for the complete degasification of the coolant. This measure for maintaining the operation of the overflow chamber is here provided merely by the special design of the walls of the water tank which, however, do not adversely influence the castability or die-castability of this part.

It will be understood that the above description of the present invention is susceptible to various modifications, changes and adaptations, and the same are intended to be comprehended within the meaning and range of equivalents of the appended claims.

What is claimed is:

1. In a water tank for a transverse flow radiator including an overflow chamber separated from a main water coolant stream collecting chamber by means of a substantially vertical partition, means for permitting a secondary stream of coolant to flow through said overflow chamber, and a fill inlet opening into said overflow chamber and adapted to be closed by a pressure relief valve, the improvement wherein said water tank is made in one piece as a cast or die-cast member; said overflow chamber is disposed coaxially below said fill inlet; and said overflow chamber has a cross-sectional area which is equal to or less than that of said fill inlet.

2. A water tank as defined in claim 1 wherein said overflow chamber is provided with a downwardly tapered cross section.

3. A water tank as defined in claim 1 wherein said tank is made of a plastic material.

4. In a transverse flow radiator including a core having a plurality of substantially horizontal coolant pipes, first and second water tanks, and a coolant inlet tube and a coolant outlet tube each opening into one of said water tanks, said first and second water tanks being connected to the respective ends of said pipes to provide a main stream of coolant therethrough, the improvement wherein said first water tank comprises a water tank as defined in claim 1.

5. A water tank as defined in claim 1 wherein said means for permitting a secondary stream of coolant includes: an overflow choke disposed in said partition near its upper end and connecting said overflow chamber with the main stream collecting chamber; and a substantially horizontal connecting channel in open communication with said overflow chamber at its lower end for connecting same with at least one row of pipes of the core of a radiator which leads to the suction side of the radiator.

6. A water tank as defined in claim 5 wherein said connecting channel is formed by an opening in said partition and a horizontal rib attached to said partition and forming the bottom of said main stream collecting chamber.

7. A water tank as defined in claim 1 wherein said water tank is provided with at least one connecting tube, disposed so that it will be on the side of the radiator, for the connection of the water tank, and hence the radiator, for coolant circulation.

8. A water tank as defined in claim 7 wherein: said at least one connecting tube is a coolant outlet tube which opens into said overflow chamber near the lower end thereof; and said overflow chamber is connected, via an opening provided near the lower end of said partition, with said main stream collecting chamber.

9. A water tank as defined in claim 7 wherein: said overflow chamber is connected with said main stream collecting chamber through an opening in the lower region of said partition; said at least one connecting tube is a coolant outlet tube which opens into said main stream collecting chamber adjacent said opening and wherein said partition is provided with a transverse rib which extends partially across said main stream collecting chamber above said outlet tube to cause a pressure difference between said collecting chamber and said overflow chamber.

10. A water tank as defined in claim 7 wherein: said means for permitting a secondary stream of coolant includes an overflow choke disposed in said partition near its upper end and connecting said overflow chamber with said main stream collecting chamber; said at least one connecting tube is a coolant entrance tube which opens into said main stream collecting chamber adjacent said choke; and a flow smoothing rib is provided within said main stream collecting chamber between said coolant entrance tube and said overflow choke.

11. A water tank as defined in claim 10 wherein said main stream collecting chamber is divided into an upper and a lower chamber by means of a substantially horizontal partition and said coolant entrance tube opens into said upper chamber.

12. A water tank as defined in claim 11 wherein: a further of said connecting tubes, constituting a coolant outlet tube, opens into said lower chamber near the lower end of same; said lower chamber is connected with said overflow chamber via an opening in said partition near the lower end thereof; and said partition is provided with a rib which extends transverse thereto within said lower chamber above said outlet tube to provide a pressure difference between said overflow chamber and said lower chamber.

* * * * *